United States Patent [19]

Brawn

[11] 3,976,056

[45] Aug. 24, 1976

[54] INTERMITTENT PRESSURE PNEUMATIC STOCKING

[76] Inventor: Peter Nelson Brawn, 36 Fairfield St., Pittsfield, Mass. 01201

[22] Filed: Jan. 20, 1975

[21] Appl. No.: 542,604

Related U.S. Application Data

[63] Continuation-in-part of Ser. No. 452,455, May 18, 1974, abandoned.

[52] U.S. Cl. ..... 128/24 R; 128/64

[51] Int. Cl.[2] ..... A61H 1/00

[58] Field of Search ..... 128/24 R, 38–40, 128/64, 60, DIG. 20, 26

[56] References Cited

UNITED STATES PATENTS

| | | | |
|---|---|---|---|
| 505,745 | 9/1893 | Barclay | 128/26 UX |
| 3,288,132 | 11/1966 | Meredith | 128/24 R |

FOREIGN PATENTS OR APPLICATIONS

| | | | |
|---|---|---|---|
| 817,521 | 7/1959 | United Kingdom | 128/60 |

*Primary Examiner*—Lawrence W. Trapp
*Attorney, Agent, or Firm*—Finnegan, Henderson, Farabow & Garrett

[57] ABSTRACT

An intermittent pressure pneumatic stocking system for creating pressure changes on selected parts of the body of the user or patient. The pneumatic stocking is filled with air or other suitable gas to a selected low pressure and through slight movements of a bedridden patient intermittent pressure changes to selected external areas of the body are achieved. Movements of the patient cause pressure and volume changes in a first pneumatic sac placed under the patient or wrapped around the torso of the patient. These changes in pressure and volume cause gas displacement through pneumatic tubing to at least one second pneumatic sac located on one of the patient's extremities. The second pneumatic sac is so arranged to surround the particular region such as the calf of a leg. Each of the pneumatic sacs may be divided into a plurality of compartments. Tubes, valves and other pressure equalizing elements are used between connecting pneumatic tubes, compartments, or sacs to provide a gradual equalization of pressure between the respective first and second pneumatic sacs after each pressure change caused by movement of the patient. The total system is so constructed to promote increased pressure on the selected part of the body followed by a slow — 5 to 10 second — release of the pressure.

18 Claims, 8 Drawing Figures

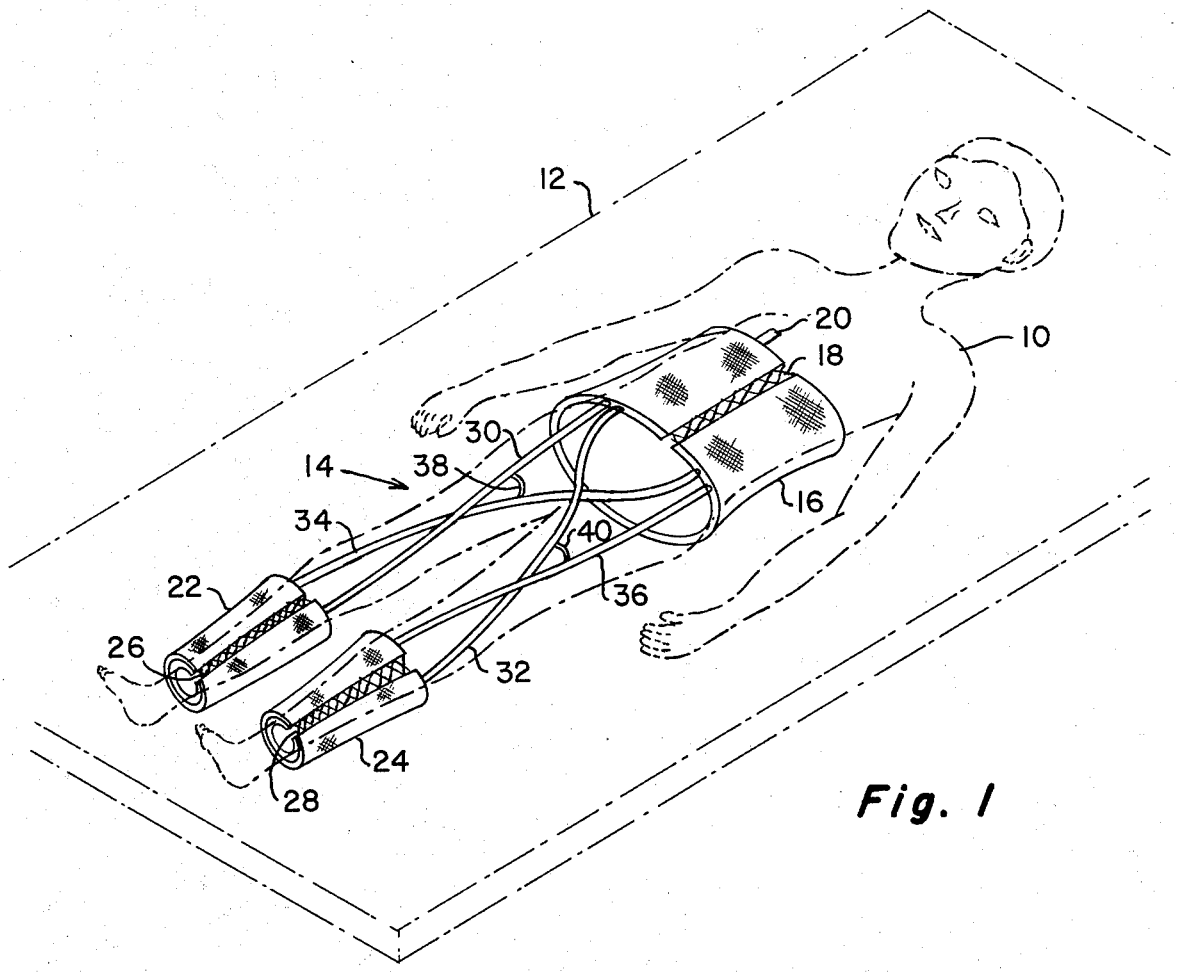
Fig. 1
Fig. 2
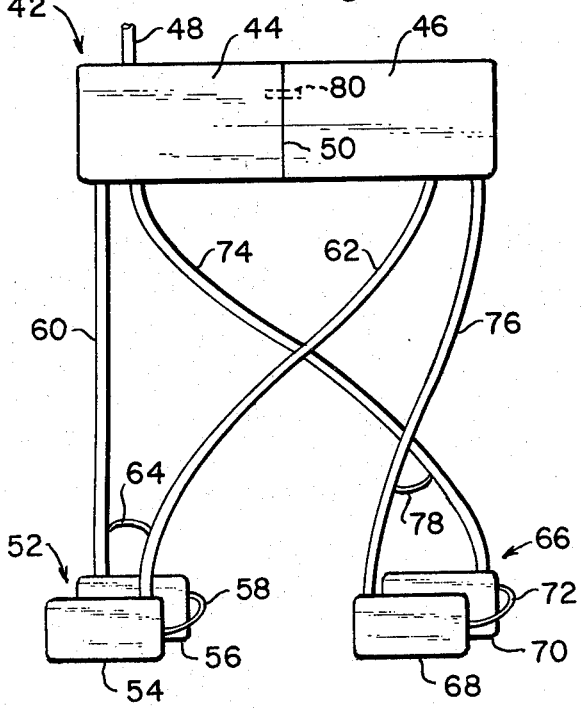
Fig. 3
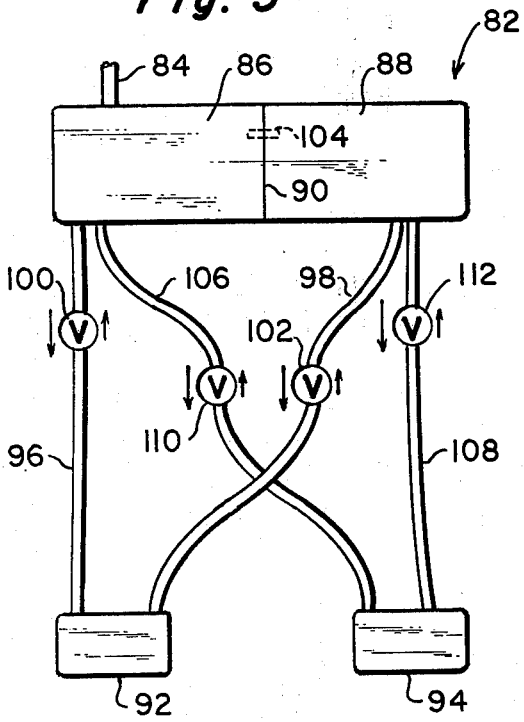

INTERMITTENT PRESSURE PNEUMATIC STOCKING

BACKGROUND OF THE INVENTION

This application is a continuation-in-part of application Ser. No. 452,455, filed May 18, 1974, and now abandoned.

The present invention relates to a closed pneumatic system which provides intermittent pneumatic pressure to the extremities of the bedridden patient without the need of a compressor or other active element.

It has been demonstrated that intermittent compression applied externally to the lower leg of a patient during surgery and for 48 hours afterwards is an effective method to prevent or reduce post-operative thrombophebitis. Intermittent compression of the calves evidently alters the venous blood flow characteristics of the patient.

At least one intermittent calf compression device has been used during operations to stimulate venous flow. This device uses a pneumatic regulator connected to a source of compressed air. The regulator delivers a short 6 second compression with a maximum pressure of 45 mm Hg to each leg every 100 seconds through pneumatic couplings to special below-knee plastic splints attached to the patient.

Another commercial device applies the same principle by providing pneumatic compression of the calves to force return of blood to the heart. It compresses the calf with each heart beat. This device is a complex and sophisticated electronically controlled device.

Although there are devices found in the prior art, which operate on the principle of providing intermittent pressure to selected extremities of a patient to stimulate venous flow, these devices are in the main complicated and expensive to manufacture requiring well-trained technicians to operate them properly.

SUMMARY OF THE INVENTION

The present invention overcomes the problems of the prior art by providing an intermittent pressure pneumatic closed system for use with a gas or air to stimulate venous flow. Considered in it broad aspect the pneumatic stocking closed system comprises a first or primary pneumatic gas sac which is either placed under the body of the patient as an air mattress or wrapped around and attached to the torso of the patient and a second pneumatic gas sac attached to a limb, e.g. around the calf of a leg, of the user. Connecting pneumatic tubes between the first and second pneumatic gas sacs provide conduits for gas flow between the sacs. When the patient moves, thereby varying pressure and volume in the first pneumatic sac, gas is displaced and forced into the second sac. Finally, elements, such as small diameter tubing, check valves, or restricted wall openings between compartments, are used to cause equalization of pressure between the first and second pneumatic gas sacs after the movement of the patient has caused a disturbance in terms of volume and pressure changes in the first pneumatic gas sac.

Preferably, in operation, the movement of the patient causes increased pressure in certain compartments of the second pneumatic gas sac, thereby having a compressive effect on the limb which is gradually reduced as pressure is equalized between the sacs. Ideally, the system is so designed to provide an equalization of pressure within the total pneumatic stocking system within 5 to 10 seconds after the initial increase in pressure in the second pneumatic sac so blood flow is not interrupted too long. It is preferred that a first pneumatic gas sac which is placed under the patient or attached around the torso of the patient include at least two separate adjacent compartments. Preferably these compartments are wedge shaped and of substantially equal volume.

It is also preferred that the second pneumatic gas sac which is placed around the limb of the patient include a plurality of separate but adjacent compartments which when attached to a limb of the patient are in a concentric layered relationship one to the next around the limb.

It is also preferred that the individual compartments of the second pneumatic gas sac be connected to corresponding individual compartments of the first pneumatic gas sac so that the same amount of movement regardless of direction or position will cause substantially the same gas displacement to the second pneumatic gas sac.

It is further preferred to utilize check valves in the connecting tubing between the first and second pneumatic gas sacs to allow free flow from the first pneumatic gas sac to the second pneumatic gas sac while impeding the gas flow from the second pneumatic gas sac to the first pneumatic gas sac. This action allows for a quick increase in the volume of the second pneumatic gas sac and a corresponding increased compressive pressure on the selected part of the body. Because of the impeding action of the check valves in the reverse direction, this pressure is gradually released.

BRIEF DESCRIPTION OF THE DRAWINGS

In the drawings, FIG. 1 is a representation of the intermittent pressure pneumatic stocking operatively attached to a patient.

FIG. 2 is a schematic representation of a preferred embodiment of the intermittent pressure pneumatic stocking closed system.

FIG. 3 is a schematic representation of another preferred embodiment which utilizes check valves.

DESCRIPTION OF THE PREFERRED EMBODIMENT

Figure 4:
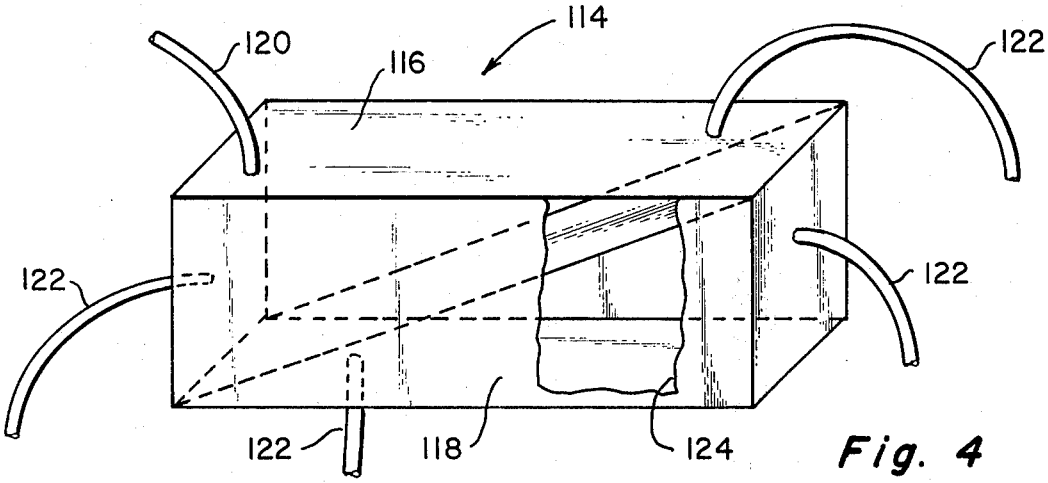
FIG. 4 is a schematic representation of a preferred construction of the primary gas sac responsive to body movement as used in the invention.

Reference will now be made in detail to the present preferred embodiment of the invention, examples of which are illustrated in the accompanying drawings.

Referring first to FIG. 1, there is shown a patient 10 reclining on a platform or bed 12. Attached to the torso and legs of patient 10 is the intermittent pressure pneumatic stocking closed system 14 of the present invention. In accordance with the invention, there is provided a first or primary pneumatic gas sac 16 which encompasses the torso of patient 10. Preferably the first pneumatic gas sac 16 is held snuggly in place by ties 18. It will be understood that other attaching means can be used such as hooks or velcrove tape.

Valve 20 is provided for inflating the pneumatic stocking system with a gas, usually air, to a preselected pressure. The pressure should be low enough not to restrict breathing or blood flow and is established for the patient with his weight applied in a prone position to sac 16.

It is preferred that second and third pneumatic gas sacs 22 and 24 respectively are attached below the knees and around the calves of patient 10. Sacs 22 and 24 are wrapped concentric with the calves of patient 10 and brought together and held by ties 26 and 28 respectively. Velcrove tape or hooks can be used as well as the ties shown in FIG. 1.

Preferably means for connecting the first gas sac 16 with the second and third gas sacs 22 and 24 for transmitting pressure and volume changes between the sacs is in the form of the tubes 30, 32, 34 and 36. Tubes 30 and 34 connect the first gas sac 16 to the second gas sac 22, and tubes 32 and 36 connect the first gas sac 16 to the third gas sac 24.

It is further preferred that means responsive to pressure differences within the closed pneumatic system be provided to gradually reduce pneumatic pressure differences between the first and second pneumatic gas sacs. As herein embodied the means include small diameter tubing 38 and 40 connecting respectively tubes 30 and 32 and tubes 34 and 36. The exact sizing of tubes 38 and 40 is not critical but typically might have a diameter one-quarter that of the principle tubes 30, 32, 34 and 36.

Movement of the patient 10 shown in FIG. 1 causes compressive effects in parts of pneumatic gas sac 16 forcing gas flow out and into the pneumatic gas sacs 22 and 24. The sacs 22 and 24 expand, increasing the pressure upon the calves of patient 10. As will be explained in greater detail, the gas then slowly flows to other parts of sac 16 tending to return all pressures within the system 14 to static equalized state. The small diameter tubing 38 and 40 assists in returning pressure to the normal equalized pressure as do other devices within the gas sacs 16, 22 and 24, which are described below.

The pneumatic gas sacs 16, 22 and 24, and those to be described below, are constructed of an expansible, gas impermeable material. Plastic materials or a rubberized fabric are typical materials which can be used.

Referring now to FIG. 2, there is shown a schematic diagram of a preferred embodiment of the present invention. As here embodied, a first pneumatic sac 42 is shown having two compartments 44 and 46. The pneumatic sac 42 is adapted to respond to movement of the body of a user when placed under the user as an air mattress or wrapped about the torso of the user, the user being prone as in FIG. 1. Movement of the user then tends to increase or decrease the pneumatic pressure in the sac 42 with a corresponding tendency to decrease or increase respectively the volume of the gas in sac 42 by displacement of gas.

A valve 48 is provided for filling sac 42 with gas to some predetermined pressure. Air, being the most convenient, is preferred.

Preferably pneumatic gas sac 42 includes at least two compartments 44 and 46 but can, if desired, include additional compartments. The compartments 44 and 46 have a wall 50 in common. These compartments 44 and 46 are shown in FIG. 2 schematically as being of substantially the same volume and of rectangular shape. It will be understood however that other shapes can be utilized in the pneumatic stocking closed system as is discussed below in connection with FIG. 4.

Preferably there is a second pneumatic gas sac 52 which is adapted to be attached to at least one limb of the user. The pneumatic sac 52 as here embodied includes at least two compartments adapted to be attached in a concentric manner about a portion of the limb of the user. Since the representation of FIG. 2 is schematic in nature, it should be understood that the compartments 54 and 56 can be constructed to have a common side wall so that the two compartments are layered one on top of the other.

As here embodied, tube 58 represents means responsive to pressure differences created within the system to gradually reduce pneumatic pressure differences between the first and second pneumatic gas sacs 42 and 52. The small diameter tube 58 connects the compartments 54 and 56. It will be readily understood that other types of connections can be made through the common wall between compartments 54 and 56 to achieve the same result. Thus, small perforations in the wall or a restrictive type opening, i.e. inserting a piece of material into the wall of low permeability to gas, would serve to equalize the pressures and volumes of the compartments 52 and 56. Whatever elements are used, however, the flow of gas should be restricted relative to the flow of gas through the principle connecting tubes of the system.

Preferably, means for connecting the first and second pneumatic sacs 42 and 52 are provided as pneumatic tubes 60 and 62. The tubes 60 and 62 act to transmit pressure and volume changes between the first and second pneumatic sacs 42 and 52 resulting from movement of the patient.

Preferably further means responsive to pressure differences within the system are provided in the form of a smaller diameter tube 64 which interconnects the tube 60 to 62. Tube 64 assists in gradually reducing pneumatic pressure differences which are developed between the first and second pneumatic sacs 42 and 52 through movement of the patient.

Preferably a third sac 66 is provided which is adapted to be attached to another limb of the user. In a typical application, the second sac 52 and the third sac 66 are attached to the calves of the user (as shown in FIG. 1.)

The pneumatic gas sac 66 is of similar construction and material as that of gas sac 52. As here embodied, it comprises two compartments 68 and 70 which are interconnected by small diameter tubing 72. Normally the compartments 68 and 70 are adjacent one another and have a common wall between. The compartments 68 and 70 is thereby in a layered configuration adapted to be attached to a limb with each compartment concentric to the limb.

It is preferred that means for connecting the first and third pneumatic gas sacs, 42 and 66 respectively, be provided in the form of tubes 74 and 76. It is further preferred that a small diameter tube 78 interconnect the principal connecting tubes 74 and 76.

It is preferred that the means connecting pneumatic gas sac 42 with pneumatic gas sacs 52 and 66 be as shown in FIG. 2 for best results. Thus first compartments 54 and 68 of the pneumatic gas sacs 52 and 66 respectively are connected by tubes 62 and 76 to the compartment 46 of the first pneumatic sac 42. Compartments 54 and 68 are the interior compartments of their respective gas sacs 52 and 66 and are placed next adjacent the limb of the user.

The second compartments 56 and 70 of the pneumatic gas sacs 52 and 66 respectively are each connected by tubes 60 and 74 to the compartment 44 of the pneumatic gas sac 42. The compartments 56 and 70 are the next concentric layer above the first compartments 54 and 68 respectively as applied to the patient's limb.

The pneumatic sacs 52 and 66 can include additional adjacent compartments beyond those shown in FIG. 2 so arranged and constructed that when attached to a limb of the user, each of the additional compartments surrounds the limb in a sequential concentric fashion. Further, the first pneumatic sac 42 would then include a plurality of compartments beyond the two shown equal to the number of compartments of each of the pneumatic gas sacs 52 and 66. The connecting tubes between the additional compartments of the first sac 42 and the second and third sacs 52 and 66 would be connected in a fashion similar to that shown in FIG. 2. That is, a particular compartment of sac 42 would be connected to a compartment of each of the sacs 52 and 66, each compartment of sacs 52 and 66 being in the same concentric sequence.

Still referring to FIG. 2, it is preferred that additional means responsive to pressure differences within the system in the form of small perforations in wall 50 or a restricted opening 80 in wall 50, as by inserting a low gas permeability material into wall 50, be provided between compartments 44 and 46. Such a restricted opening 80 allows for gradually reducing pneumatic pressure differences within the total closed system and specifically between the primary pneumatic gas sac 42 and the two other sacs 62 and 66.

Referring now to FIG. 3, another preferred embodiment utilizing check valves is shown. A first pneumatic gas sac 82 is constructed of an expansible, gas impermeable material. A valve 84 is available through which to add gas, usually air, to the sac 82 and the total system of FIG. 3. It is preferred that the pneumatic gas sac 82 be adapted to respond to movements of the user when placed next adjacent the user's body. Preferably the pneumatic gas sac 82 can take the form of an air mattress adapted to be placed under the user or patient. Alternatively, the sac 82 can be wrapped about the torso of the patient in a prone position and attached by ties or other hooking means not shown.

As here embodied, pneumatic gas sac 82 is divided into two compartments 86 and 88 of substantially equal volume. The compartments 86 and 88 are divided by a common wall 90.

Further a second pneumatic sac 92 is constructed of material similar to that of sac 82. A third pneumatic sac 94 is also provided of a material similar to that of sac 82.

Preferably second and third pneumatic sacs 92 and 94 are adapted to be attached to a limb of the user such as to the calves of the legs. Furthermore, it is to be preferred that the sacs 92 and 94 attach to the limb of the user, surrounding the limb in a concentric fashion. As shown in FIG. 3, the sacs 92 and 94 each comprise only one compartment, but it will readily be understood as discussed in conjunction with FIG. 2 that additional compartments can be added to each of the pneumatic sacs 92 and 94.

It is preferred that there be provided means for connecting the first and second pneumatic gas sacs 82 and 92 respectively, for transmitting pressure and volume changes between the sacs due to movement of the user. As here embodied, principal tubes 96 and 98 connect the pneumatic gas sac 92 with compartments 86 and 88 respectively of sac 82.

It is further preferred that means be provided responsive to pressure differences within the system for gradually reducing those differences between the pneumatic gas sacs 82 and 92. As here embodied, check valves 100 and 102 in tubes 96 and 98 respectively are utilized for this purpose. Each valve 100 and 102 allows unimpeded flow from the primary pneumatic gas sac 82 to the second pneumatic gas sac 92 but restricts gas flow in the opposite direction. In actual use as when the patient rolls onto compartment 86 compressing the gas or air therein, and ignoring the effect of sac 94, the gas flow will be into sac 92 through tube 96 and check valve 100. This flow will be unimpeded. A slower and restricted flow of gas will subsequently occur from sac 92 through tube 98 and check valve 102 to compartment 88 of sac 82. This restrictive flow will gradually equalize the pressures in the total pneumatic stocking closed system. Perforations in wall 90 or a restricted opening 104 through wall 90, as previously described, assist in the equalization of pressure throughout the system.

Preferably the third pneumatic gas sac 94 is connected in a similar manner to the first pneumatic gas sac 82 through principal tubes 106 and 108 to compartments 88 and 86 respectively of sac 82. Check valves 110 and 112 are likewise placed in tubes 106 and 108 respectively. When attached to a patient lying in a prone position the pneumatic sac 94 responds to changes in pressure and volume of the gas contained in the pneumatic sac 82 caused by movement of the patient in a manner similar to that of pneumatic gas sac 92 discussed above.

It will be recognized that the particular closed pneumatic system of FIGS. 3 operates in such a manner that the pneumatic gas sacs 92 and 94 in addition to being independent upon pressure and volume changes in the primary pneumatic gas sac 82 will each also respond to the gas dynamics occurring in the other sac. This is so since sacs 92 and 94 are connected in parallel with the primary pneumatic gas sac 82.

Referring now to FIGS. 2 and 3 together, it is evident that similar results are obtained in the one case by using interconnecting small diameter tubes between compartments and between major tubes of the system while in the other case use is made of check valves. Thus in both cases, when the patient moves, a volume change occurs in the primary gas sac which creates an increased pressure on the limbs of the patient through displacement of gas to the secondary sacs which is subsequently and gradually relieved as the pressure equalizes throughout the system. The slow gradual equalization of pressures throughout the system is achieved by different structures in the embodiments shown respectively in FIGS. 2 and 3. But it will be clear to one skilled in the art, that the various pressure equalizing conduit features shown in FIGS. 2 and 3, including the small diameter tube connections, the restricted openings between compartments and the check valves can all be used in one system to reduce cooperatively pneumatic pressure differences within the closed system.

Referring now to FIG. 4, there is shown a preferred construction of the first or primary pneumatic gas sac 114 of the intermittent pressure pneumatic stocking closed system of this invention. The sac 114 is divided into two wedge-shaped compartments 116 and 118 of substantially equal volume. In use the front face 124 of sac 114 is placed against the torso of the user. A valve 120 is shown connected to compartment 116 through which gas or air can be introduced to the pneumatic stocking closed system. In addition, various pneumatic tubes 122 are connected to the two compartments 116 and 118 of sac 114 which can be attached to various secondary pneumatic gas sacs to be attached to the limbs of the user.

The wedge-shaped compartments 116 and 118 of the pneumatic gas sac 114 are preferred in that the slightest body movement of the user causes displacement of gas from the primary gas sac 114 to one of the secondary pneumatic gas sacs attached to a limb of the user. If the compartments of the primary gas sac are each of a general cubic or rectangular shape, many more compartments are required in both the primary and secondary pneumatic sacs to ensure proper displacement of air from the primary to at least one of the secondary sacs. Otherwise a body movement is likely to cause only displacement of gas from one portion of a compartment to another portion of the same compartment. This results in movement of air or gas in the primary sac but does not necessarily result in gas flow to one of the other secondary gas sacs.

An additional advantage of the wedge-shaped compartments 116 and 118 of gas sac 114 is the reduction in number of tubes required from the primary gas sac 114 to the secondary sacs attached to the limbs of the user. When two secondary gas sacs are attached to the limb of the user, the two compartments 116 and 118 require no more tubing than that shown in FIG. 4.

Figure 5:
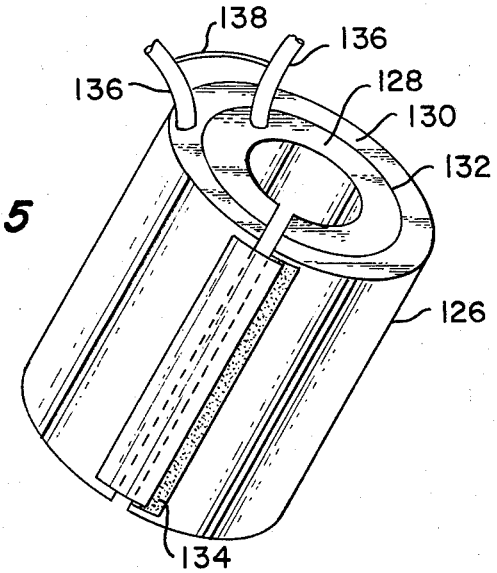
FIG. 5 is a schematic detailed representation of a secondary pneumatic gas sac adapted to be applied to a limb of the patient.

With reference now to FIG. 5, there is shown in detail a secondary air sac of the intermittent pneumatic pressure stocking closed system as shaped to conform to a limb of a user. This air sac corresponds to the sacs 52 and 66 of FIG. 2 for instance. The sac 126 is comprised of two layered compartments 128 and 130 which interface at the common wall 132. The gas sac 126 can be wrapped about a limb, such as a calf of a leg, and held fast by velcrove tape 134. Tubes 136 connect each of the compartments 128 and 130 to the primary gas sac of the pneumatic stocking closed system (not shown in FIG. 5). It is readily seen that the layered compartments 128 and 130 when applied to a limb conform to the limb in a concentric fashion.

Preferably pressure equalizing conduit means here embodied as a smaller diameter tube 138 connect the two tubes 138. The tube 138 assists in gradually reducing pneumatic pressure differences between the several pneumatic gas sacs following movement of the user.

Figure 6:
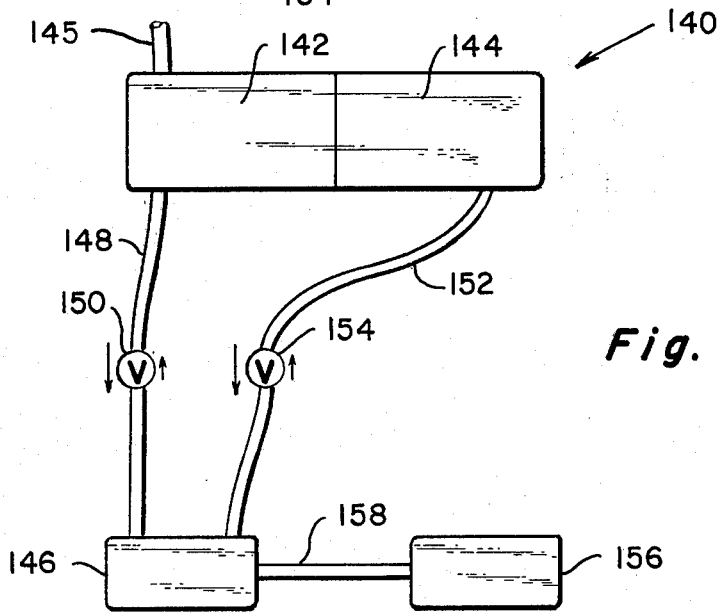
FIG. 6 is another preferred embodiment of the intermittent pressure pneumatic stocking closed system of this invention.

FIG. 6 shows another preferred embodiment of the intermittent pressure pneumatic stocking closed system. It is preferred that a first primary pneumatic gas sac 140 constructed of an expansible non permeable material be adapted to respond to the movement of a user when placed next adjacent the user's body, either beneath the body in the form of an air mattress or loosely wrapped about the torso of the body. Preferably, the pneumatic sac 140 responds to such movement by tending to increase or decrease the pneumatic pressure in sac 140 and simultaneously increase or decrease the volume of gas therein causing gas displacement within the system.

As here embodied, the primary or first pneumatic sac 140 is comprised of two compartments 142 and 144 of substantially equal volume. Air or gas contained in compartment 142 can be displaced through means connecting pneumatic gas sac 140 to a secondary pneumatic sac 146. As here embodied the connecting means is tube 148.

Further, as here embodied, means are provided responsive to pressure differences within the total system for gradually reducing pneumatic pressure differences between sacs 140 and 146 in the form of check valve 150. Compartment 144 of pneumatic gas sac 140 is connected to secondary pneumatic gas sacs 146 through tube 152. Check valve 154 is inserted in tube 152 to provide means responsive to pressure differences within the system for reducing gradually the pneumatic pressure differences between sacs 140 and 146.

It is preferred that the check valves 150 and 154 operate to allow unimpeded gas flow from the first gas sac 140 to the second gas sac 146. However, reverse flow of gas from sac 146 to sac 140 is restricted by the check valves 150 and 154.

Preferably as shown in FIG. 6 a third pneumatic sac 156 adapted to be attached to another limb of the user is pneumatically connected by tube 158 to the second pneumatic sac 146 so as to respond directly to changes in pressure and volume in the pneumatic sac 146.

Figure 7:
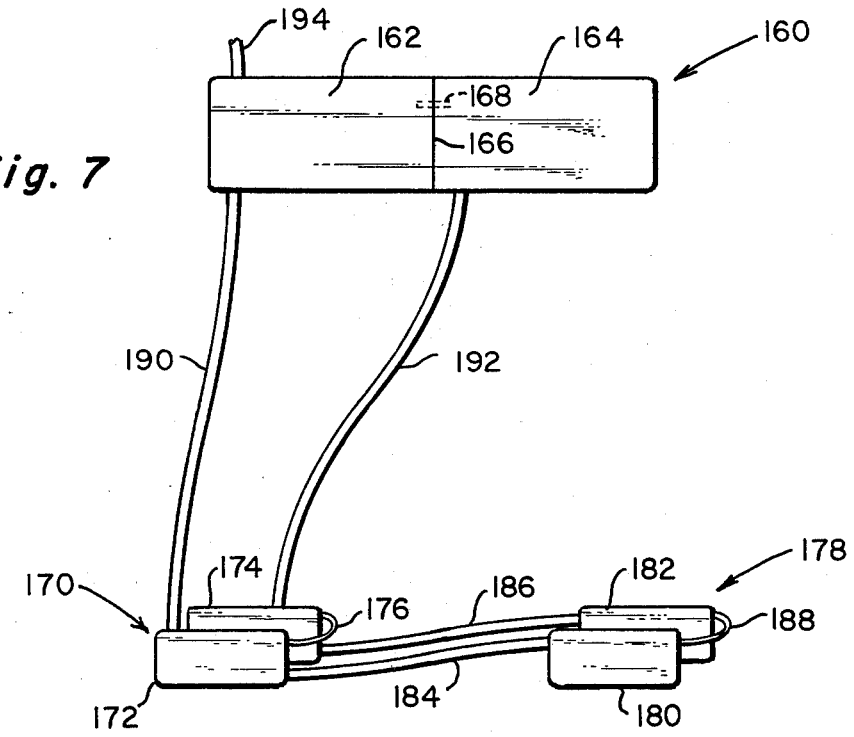
FIG. 7 is a further embodiment of the intermittent pressure pneumatic gas sac closed system of this invention.

Referring now to FIG. 7, an intermittent pressure pneumatic stocking closed system is shown which is similar to that already described for FIG. 6 but which does not utilize check valves. As here embodied the primary or first pneumatic sac 160 is constructed of an expansible nonpermeable material. The first sac 160 is divided into two compartments 162 and 164 of substantially equal volume. A common wall 166 between compartments 162 and 164 incorporates small perforations or a restricted opening 168 therein to assist the total system in gradually reducing pneumatic pressure differences between pneumatic sacs.

Preferably a second pneumatic sac 170 is provided which is adapted to be attached to a limb of the user. The pneumatic gas sac 170 is schematically shown as comprised of two compartments, 172 and 174. These compartments, although shown as separate entities, normally would be constructed having one sidewall in common. Further, it is preferred that pressure equalizing conduit means connecting the compartments 172 and 174 of pneumatic sac 170 be provided as a small diameter tube 176. It will be well understood that small perforations or restricted openings incorporated into the common wall between compartments 172 and 174 will serve a similar purpose to that of the small diameter tubing 176. This can be accomplished by inserting a section of low gas permeability material into the common sidewall which separates 172 and 174.

As here embodied in FIG. 7, a third pneumatic gas sac 178 is constructed with two compartments 180 and 182 of substantially the same volume. These compartments 180 and 182, shown schematically in FIG. 7, normally would have a common wall between them and in essence would be layered compartments such the same as for the compartments of sac 170.

As here embodied the third pneumatic gas sac 178 is pneumatically connected by means of tubes 184 and 186 to the second pneumatic sac 170 so as to respond directly to changes in pressure and volume in pneumatic sac 170.

Additionally, it is preferred to utilize a pressure equalizing conduit in the form of a smaller diameter tube 188 connecting compartments 180 of 182 of pneumatic gas sac 178 to assist in gradually reducing pneumatic pressure differences in the closed system.

Finally, with regard to FIG. 7, means connecting pneumatic gas sac 160 with gas sac 170 are provided in the form of principal tube 190 connecting compartment 162 of sac 160 with compartment 172 of sac 170, and tube 192 connecting compartment 164 of gas sac 160 with compartment 176 of gas sac 170. These principal tubes 190 and 192 transmit pressure and volume changes between the first pneumatic gas sac 160 and the second pneumatic gas sac 170 when the primary sac 160 is compressed by movement of the patient.

Preferably, the intermittent pressure pneumatic stocking closed system of FIG. 7 operates to apply substantially simultaneous pressure to the limbs of the patient when gas is displaced from the primary sac 160 to the secondary sacs 170 and 178. The initial compressive force applied to the gas sac 160 will cause displacement of gas from one of the compartments 162 or 164, which in turn will flow through the respective principle tubes 190 or 192. The gradual return to a static gas condition throughout the system, and an equalization of pressure, occurs through the operation of the small diameter tubes 176 and 188, the restricted openings 168 in wall 166, and indeed some reverse flow through one or the other of the principal tubes 190 or 192.

Figure 8:
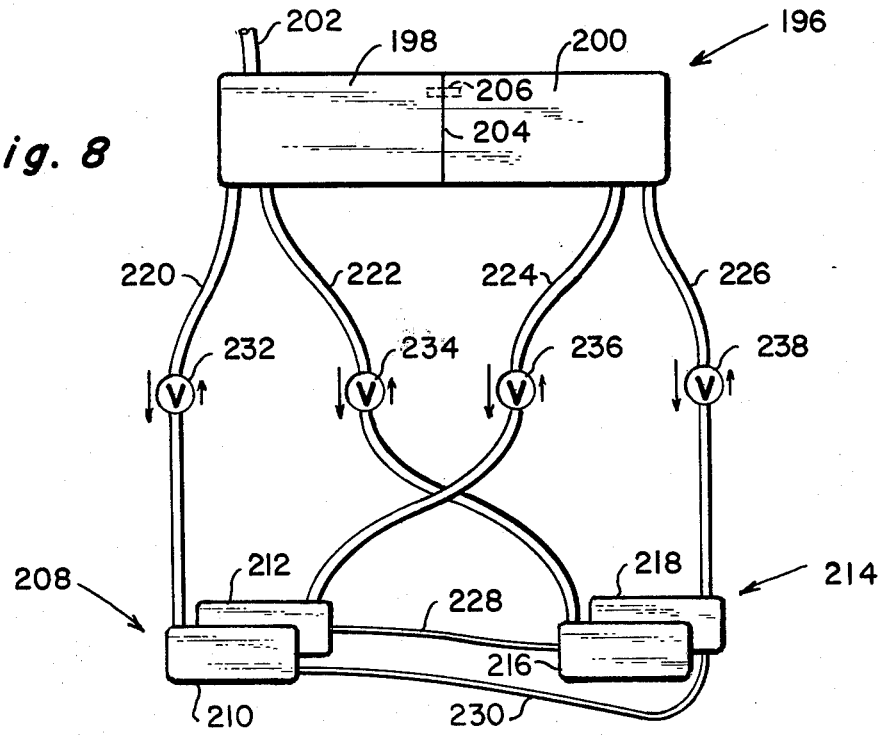
FIG. 8 is yet another preferred embodiment of this intermittent pressure pneumatic stocking closed system of this invention.

Referring now to the embodiment shown in FIG. 8, there is a first or primary gas sac 196 which is divided into two compartments, 198 and 200 of substantially equal volume. The primary sac 196, constructed of an expansible nonpermeable material, is inflated through valve 202. A here embodied, a common wall 204 separates the two compartments 198 and 200. A restricted opening 206 of the type previously described is found in the wall 204. This restricted opening 206 operates as a pressure equalizing conduit between the two compartments.

It is preferred that a second pneumatic gas sac 208 be constructeed to include two compartments 210 and 212 of substantially equal volume. Although schematically shown as separate in FIG. 8, the compartments 210 and 212 are preferably constructed in a layered fashion with a common side wall so constructed to be attached to a limb of a patient, so that each of the compartments surrounds the limb in a concentric fashion.

It is further preferred that a third pneumatic gas sac 214 be provided with two compartments 216 and 218 of substantially equal volume. Although shown schematically as separate compartments, the preferred construction of gas sac 214 is with a common side wall between compartments 216 and 218 in a layered relationship to be attached to a limb of a patient so that each of the compartments 216 and 218 surrounds the limb in a concentric layered fashion. Both sacs, 208 and 214, can be attached to a patient as shown in FIG. 5.

Preferably means connecting the primary gas sac 196 to the secondary gas sacs 208 and 214 is in the form of pneumatic tubes 220, 222, 224 and 226. These tubes provide means for displacing gas between the primary sac 196 and the secondary gas sacs 208 and 214. It is preferred to incorporate into the principal pneumatic tubes 220, 222, 224 and 226 check valves 232, 234, 236 and 238. These check valves are responsive to pressure differences between the first gas sac 196 and the gas sac 208 and 214 in a manner to allow unimpeded gas flow in the direction from sac 196 to sacs 208 and 214, but to restrict the gas flow in the reverse direction from gas sacs 208 and 214 to the first gas sac 196.

The check valves 232, 234, 236 and 238 of FIG. 8, and the check valves associated with the systems shown in FIGS. 3 and 6 are familiar to one skilled in the art. Since the internal construction of such valves does not form a part of the present invention, they are not described in detail herein.

Referring again to FIG. 8, it is preferred that pressure equalizing conduits, here embodied as small diameter tubes 228 and 230, connect alternate compartments of the gas sacs 208 and 214. Thus, the small diameter 228 connects compartment 212 of sac 208 to compartment 216 of sac 214. Small diameter tube 230 connects compartment 210 of sac 208 to compartment 218 of gas sac 214. These small diameter tubes in combination with the secondary sacs 208 and 214 and the principal pneumatic tubes 220, 222, 224, and 226, form a return flow path for gas to the compartment of the primary gas sac 196 with the lesser pressure.

In its preferred mode of operation the closed system of FIG. 8 operates in the following fashion: Compression of one compartment such as compartment 198 of the primary sac 196 causes displacement of air through tubes 220 and 222 to compartment 210 of gas sac 208 and compartment 216 of gas sac 214 respectively. This flow of gas is unimpeded by the respective check valves 232 and 234. Pressure is increased in the compartments 210 and 216 by the inflow of gas which pressure is consequently directly applied to the limbs of the patient. But gas flows from compartments 210 and 216 through the small diameter tubes 230 and 228 respectively to the compartments 218 and 212 of the secondary sacs 214 and 208 respectively. This flow of gas is slower than the initial flow from the primary sac 196 because of the smaller diameter conduit. Finally, there is the restricted flow back to sac 196 and specifically to compartment 200 through the principal tubes 224 and 226. The flow is restricted by the action of the check valves 236 and 238 respectively. Simultaneously, there will be some equalization of pressure within the gas sac 196 by action of the restricted opening 206 in wall 204.

In constructing a model closely resembling the embodiment shown in FIG. 2, it was found that the particular sizing of the principal tubes, and the pressure equalizing conduits including the smaller diameter tubes and restricted openings between compartments was not critical. Principal tubes between primary and secondary sacs having a one-quarter inch internal diameter were used. The smaller diameter tubing which was used as pressure equalizing conduits, had an internal diameter of one-sixteenth inch. Sacs constructed from a flexible vinyl material were used having compartments with surface areas approximately 10 × 6 inches. These compartments were sealed on all edges and consequently had no third dimension. The model operated satisfactorily to provide increased pressure on the calves of the user which pressure subsequently slowly was released over a period of 5 to 10 seconds.

In using the above embodiments of the intermittent pressure pneumatic stocking, movements of the thorax upon inspiratory effort only of the patient, i.e. expansion of the chest or abdomen, can also cause intermittent pressure to be applied to selected parts of the body. In some cases, when a patient may be otherwise immobilized, the body sac or primary sac can be so designed and compartmented to respond to such movement. It will be understood that such a design can easily be developed for specific requirements having once understood the basic description given above.

What is claimed is:

1. An intermittent pressure pneumatic stocking closed system for use with a gas for creating changes of pressure on selected parts of the body of a user or patient for stimulating blood flow comprising:

a first expansible, nonpermeable pneumatic gas sac adapted to respond to movement of the body of said user when placed next adjacent said body by tending to increase or decrease the pneumatic pressure in selected portions of said first pneumatic gas sac, said first pneumatic gas sac having at least two compartments with one wall portion in common;

a second expansible, nonpermeable pneumatic gas sac adapted to be attached in a layered concentric manner about at least one limb of said user and having at least two compartments with a common side wall;

means for connecting said first and second pneumatic gas sacs for transmitting pressure and gas volume changes between said first and second pneumatic gas sacs; and means constructed within said closed system responsive to gas pressure differences of the system for gradually reducing pneumatic pressure differences between said first and second pneumatic gas sacs.

2. The intermittent pressure pneumatic stocking closed system as claimed in claim 1 wherein said means for connecting said first and second pneumatic gas sacs includes a first and second tube connecting respectively first compartments of said first and second pneumatic gas sacs and second compartments of said first and second pneumatic gas sacs.

3. The intermittent pressure pneumatic stocking closed system as claimed in claim 2 in which the means responsive to pressure differences includes a first pressure equalizing conduit between said first and second compartments of said first pneumatic gas sac and second pressure equalizing conduit means connecting said first and second compartments of said second pneumatic gas sac.

4. The intermittent pressure pneumatic stocking closed system as claimed in claim 3 wherein first and second pressure equalizing conduits include a portion of the respective common walls of each said first and second gas sacs which are permeable to gas.

5. The intermittent pressure pneumatic stocking closed system as claimed in claim 3 wherein said means responsive to pressure differences includes pressure equalizing conduit means connecting said first and second tubes.

6. The intermittent pressure pneumatic stocking closed system as claimed in claim 1 wherein said second pneumatic gas sac includes a plurality of layered adjacent compartments so arranged and constructed to be attached to said limb of said user so that each of said compartments surrounds said limb in a layered concentric fashion.

7. The intermittent pressure pneumatic stocking closed system as claimed in claim 6 wherein said first pneumatic gas sac includes a plurality of compartments equal in number to the number of said compartments of said second pneumatic gas sac.

8. The intermittent pressure pneumatic stocking closed system as claimed in claim 1 wherein said means responsive to pressure differences between said first and second pneumatic gas sac includes at least one check valve operative with said connecting means to allow unimpeded flow from said first pneumatic gas sac to said second pneumatic gas sac and restricted gas flow from said second pneumatic gas sac to said first pneumatic gas sac.

9. The intermittent pressure pneumatic stocking closed system as claimed in claim 1 wherein said first pneumatic gas sac is of a hexahedron shape and includes two wedge-shaped compartments of substantially equal volume.

10. The intermittent pressure pneumatic stocking closed system as claimed in claim 1 wherein said first pneumatic gas sac is an air mattress adapted to be placed under the user or patient.

11. The intermittent pressure pneumatic stocking closed system as claimed in claim 1 fuurther including a third expansible nonpermeable pneumatic gas sac adapted to be attached to a limb of said user and responsive to pressure and gas volume changes of said first pneumatic gas sac for applying intermittent pressure to said limb occasioned by movement of said user.

12. The intermittent pressure pneumatic stocking closed system as claimed in claim 1 further including a third expansible nonpermeable pneumatic gas sac adapted to be attached to a limb of said user and pneumatically connected to said second pneumatic gas sac so as to respond directly to changes in pressure and gas volume in said second pneumatic gas sac.

13. The intermittent pressure pneumatic stocking closed system as claimed in claim 12 wherein said second and third pneumatic sacs include respectively a plurality of compartments and said means responsive to pressure differences between said first and second pneumatic sacs include pressure equalizing conduit means connecting compartments of said second gas sac with corresponding compartments of said third gas sac.

14. The intermittent pressure pneumatic stocking closed system as claimed in claim 13 wherein said pressure equalizing conduit means are small diameter tubes.

15. An intermittent pressure pneumatic stocking closed system for use with a gas to create pressure changes on portions of the body of a user or patient for stimulating blood flow, comprising:

first expansible nonpermeable pneumatic gas sac means including at least two compartments adapted to respond to movement of the body of said user when placed under or around said body to increase pneumatic pressure in portions of said first pneumatic gas sac means;

second pneumatic gas sac means including first and second gas sacs adapted to be attached to separate selected parts of said user's body;

pneumatic tube means for connecting said first with said second pneumatic gas sac means for displacing gas between said first and second sac means in response to the movement of said body; and check valve means incorporated into said pneumatic tube means responsive to pressure differences between said first and second pneumatic gas sac means allowing unimpeded gas flow from said first pneumatic gas sac means to said second pneumatic gas sac means restricted flow from said second pneumatic gas sac means to said first pneumatic gas sac means.

16. The intermittent pressure pneumatic stocking closed system as claimed in claim 15 wherein said first and second gas sacs of said second pneumatic gas sac means each include layered compartments having common adjacent walls.

17. An intermittent pressure pneumatic stocking closed system for use with a gas for creating changes of pressure on selected parts of the body of a user or patient for stimulating blood flow comprising:

a first expansible, nonpermeable pneumatic gas sac having a first and a second compartment adapted to be placed next adjacent the body of said user;

second and third expansible, nonpermeable pneumatic gas sacs each adapted to be attached to at least onoe limb of said user;

means for connecting the first compartment of said first pneumatic gas sac with said second pneumatic gas sac for transmitting pressure and gas volume changes therebetween responsive to movement of the body of said user;

means for connecting said second compartment of said first pneumatic gas sac with said third pneumatic gas sac for transmitting pressure and gas volume changes therebetween responsive to movement of the body of said user; and means constructed within said closed system responsive to gas pressure differences between said first compartment and said second pneumatic gas sac and said second compartment and said third pneumatic gas sac for gradually reducing pneumatic pressure differences therebetween.

18. An intermittent pressure pneumatic stocking closed system for use with a gas for creating changes of pressure on selected parts of the body of a user for stimulating blood flow comprising:

a first pneumatic system including a first expansible, nonpermeable pneumatic gas sac adapted to respond to movement of the body of said user when placed adjacent said body by tending to increase or decrease pressure in selected portions of said first pneumatic gas sac, a second expansible, nonpermeable gas sac, adapted to be attached to at least one limb of said user and which is capable of transmitting pneumatic pressure changes to said limb when the second pneumatic gas sac is expanded or deflated, and means for connecting said first pneumatic gas sac with said second gas sac of said first pneumatic system and for transmitting pressure and gas volume changes therebetween;

a second pneumatic system including a first expansible, nonpermeable pneumatic gas sac adapted to respond to movement of the body of said user when placed adjacent said body by tending to increase or decrease the pneumatic pressure in selected portions of said first pneumatic gas sac, a second expansible nonpermeable pneumatic gas sac adapted to be attached to at least one limb of said user and which is capable of transmitting pneumatic pressure changes to said limb when the second pneumatic gas sac is expanded or deflated, and means for connecting said first pneumatic gas sac with said second gas sac of the second pneumatic system for transmitting pressure and gas volume changes therebetween; and means within said closed system connecting said first pneumatic system with said second pneumatic system for gradually reducing gas pressure differences between said first and second systems.

* * * * *